United States Patent [19]

Ono

[11] 4,155,453

[45] May 22, 1979

[54] INFLATABLE GRIP CONTAINER

[76] Inventor: Dan D. Ono, 465 Natoma St., San Francisco, Calif. 94103

[21] Appl. No.: 881,646

[22] Filed: Feb. 27, 1978

[51] Int. Cl.[2] ..... B65D 81/02

[52] U.S. Cl. ..... 206/522; 206/811; 206/583

[58] Field of Search ..... 150/0.5; 206/316, 521–522, 206/583–584, 591–594, 811

[56] References Cited

U.S. PATENT DOCUMENTS

| | | | |
|---|---|---|---|
| 1,743,509 | 1/1930 | Zauner | 206/811 X |
| 2,444,859 | 7/1948 | Sturtevant | 206/522 X |
| 3,042,796 | 7/1962 | De Forest | 206/811 X |
| 3,302,780 | 2/1967 | Massman et al. | 206/522 |
| 3,406,746 | 10/1968 | Abildgaard | 206/583 X |

FOREIGN PATENT DOCUMENTS

| | | | |
|---|---|---|---|
| 2320243 | 3/1977 | France | 206/522 |

*Primary Examiner*—Davis T. Moorhead
*Attorney, Agent, or Firm*—George B. White

[57] ABSTRACT

In one form of the invention the container is provided with impervious double wall all around forming a compartment with an intake for inflating the double walls and a quick release for deflating at will, and a sleeve on an open end of the compartment which can be folded so as to completely seal the compartment between the double walls, and fastening means such as a zipper or twist clasp to fasten the sleeve in sealing position; at least the inner walls of the double walls are stretchable so that when inflated they conform to part of the contour of the article, such as a camera, solidly and also sealing it against any substances such as water or dirt; the inflated bag is bouyant; in another form of the invention, the shape of the container is elongated to fit in a vessel such as a canoe or the like and one side of the container is flexible but single-walled and impervious to fluid and the other side is a double wall inflatable as in the first form of the invention and is provided with a sleeve to seal its open end so as to grip the object therein and to hold the contents firmly and to render the container bouyant and waterproof.

7 Claims, 13 Drawing Figures

FIG. 6.
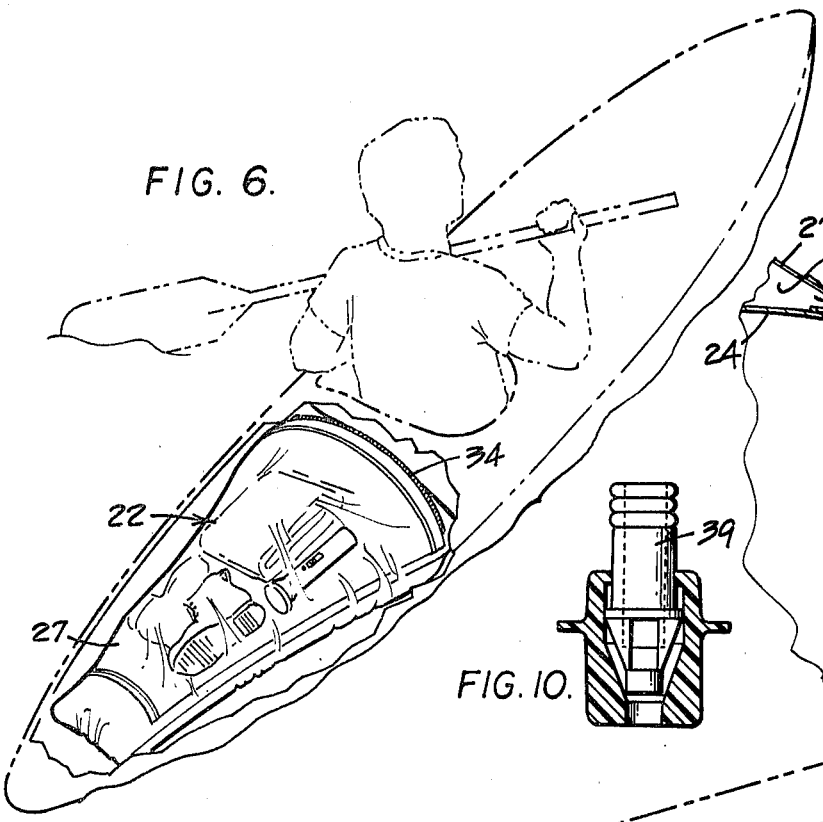
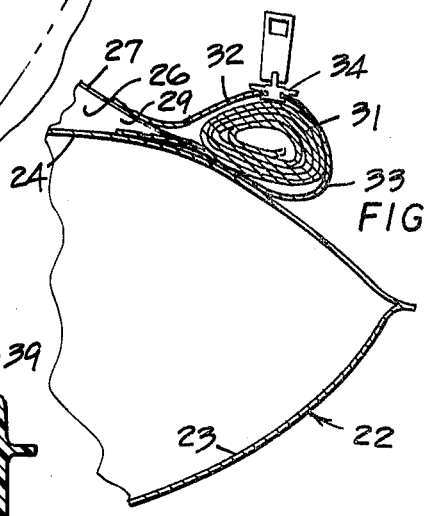
FIG. 8.
FIG. 10.
FIG. 7.
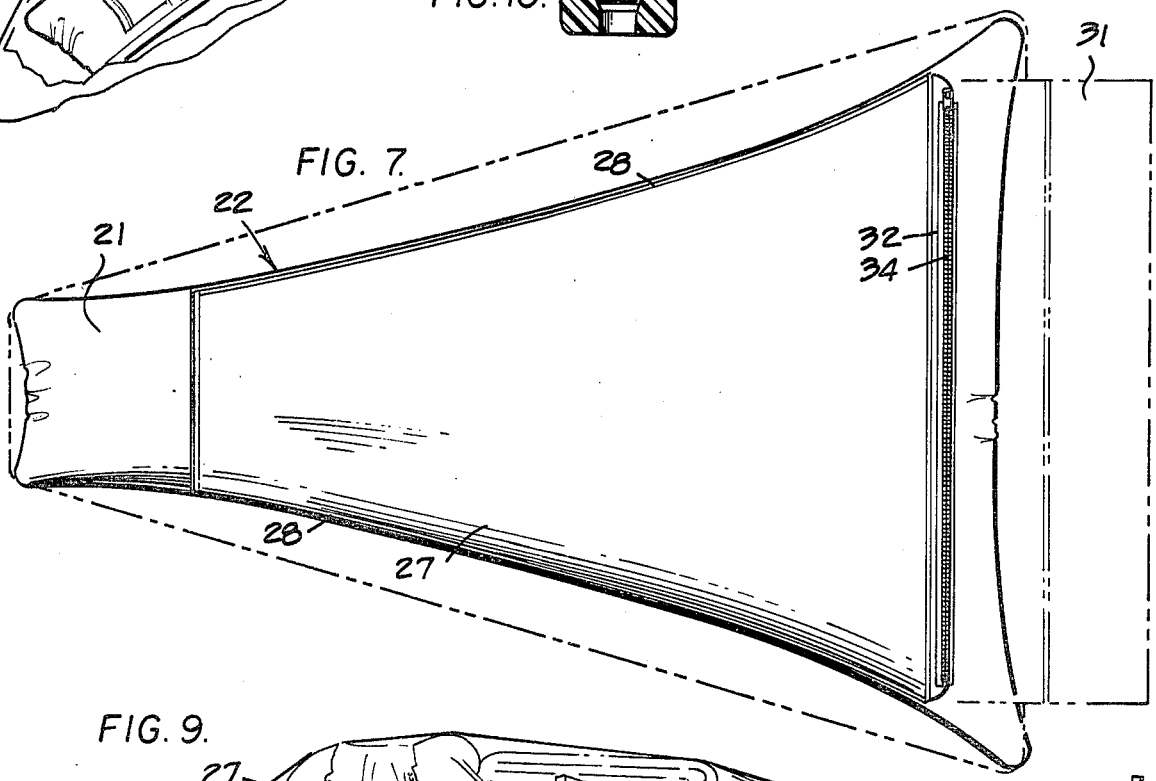
FIG. 9.
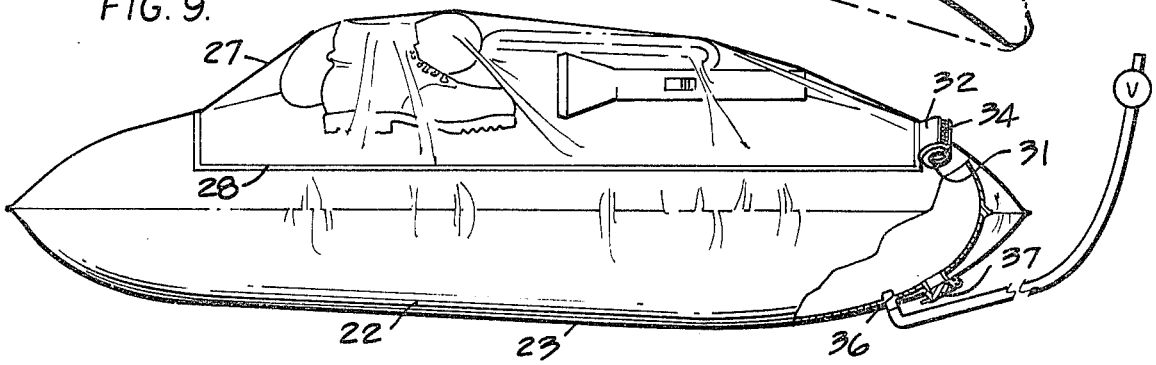

INFLATABLE GRIP CONTAINER

BACKGROUND OF THE INVENTION

While attempts may have been made in the prior art to provide waterproof cases which can float, applicant has no knowledge of any device with inflatable walls which was able to firmly grip articles against movement within the compartment surrounded by such walls and which would be bouyant.

The primary object of the invention is to provide a case which is bouyant and waterproof and wherein the inflatable side or sides of the case serve to grip the articles therein and hold them rigid against any relative movement.

BRIEF DESCRIPTION OF THE DRAWINGS

FIG. 6 is a perspective view showing the location of a storage case in a canoe.

FIG. 7 is a top-plan view of the case with the zipper and the sealing sleeve in closed position, the broken lines indicating the deflated case and the extended position of the sealing sleeve.

FIG. 8 is an enlarged fragmental cross-sectional view illustrating the folding of the sealing sleeve and the fastening of same.

FIG. 9 is a longitudinal side-view showing the bouyant sealing flap with accessories and articles firmly locked and gripped therein and the inflating tube in operative position.

FIG. 10 is a sectional view of a push and pull-type valve used as intake and storage value herein.

DETAILED DESCRIPTION

Figure 1:
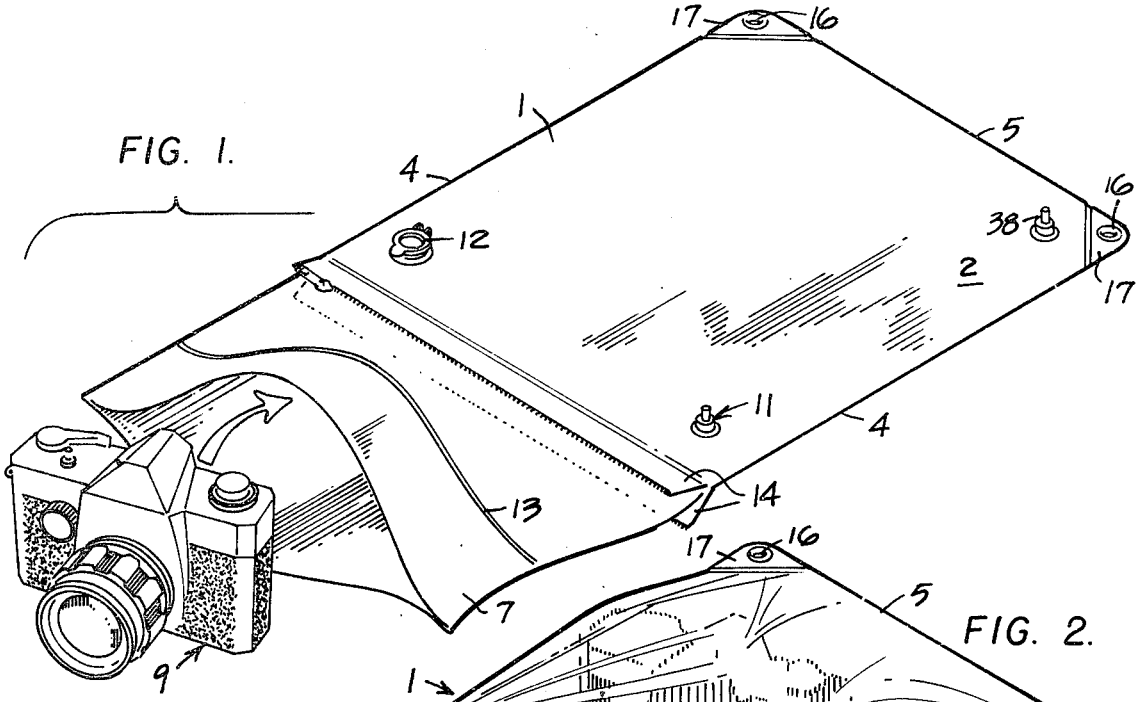
FIG. 1 is a perspective view of the collapsed inflatable case and a camera about to be introduced into the case.
Figure 2:
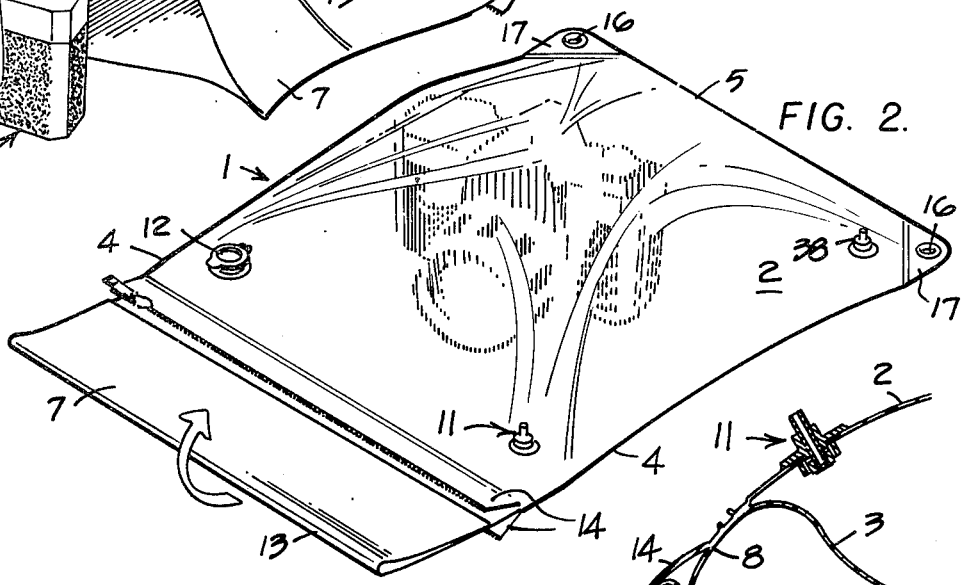
FIG. 2 shows a perspective view of the camera in the inflated case showing the direction of folding of the sealing sleeve.

In the embodiment of the invention shown in FIGS. 1 to 5, a bouyant case 1 has opposite sidewalls. Each sidewall is double-walled, namely it has an outside wall 2 and an inside wall 3 sealed at the opposite edges 4. Both walls are also sealed together along the edges 4 as well as at the closed end 5. The walls are made of waterproof material such as suitable vinyl, and form a compartment 6. At the open end of the case the inner walls 3 are extended outwardly to form a sleeve 7 which extends beyond the sealed edges 8 of the respective walls 2 and 3 at the open end.

As shown in FIG. 1, the sleeve 7 when opened can accommodate an article such as a camera 9 so that it can be inserted through the sleeve 7 into the compartment 6 between the inner walls 3 of the case. The outer wall of the case has an inflating or storage valve 11 and also a quick release device 12, which latter in the present form is a tight plug in an opening larger than the inflating valve for quick deflation.

Figure 4:
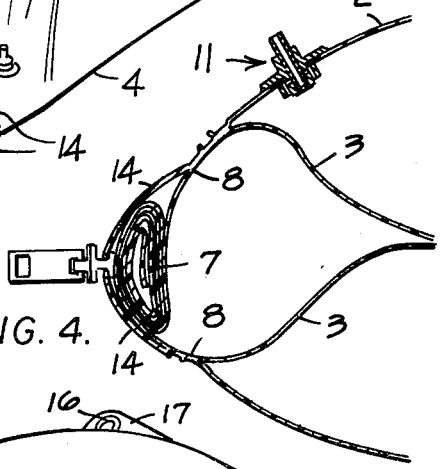
FIG. 4 is an enlarged fragmental sectional view of the area indicated by the circle and arrows in FIG. 3 illustrating the folding and fastening of the sealing sleeve.
Figure 3:
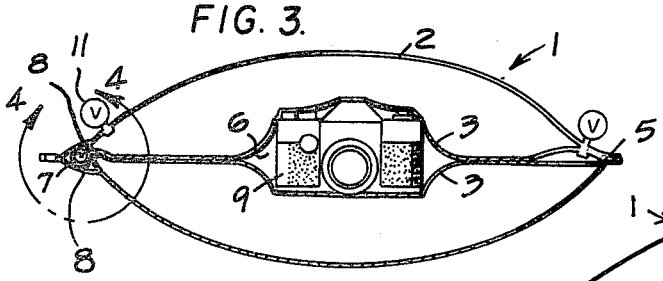
FIG. 3 is a cross-sectional view showing the case inflated and the camera firmly gripped between the inner walls thereof.
Figure 5:
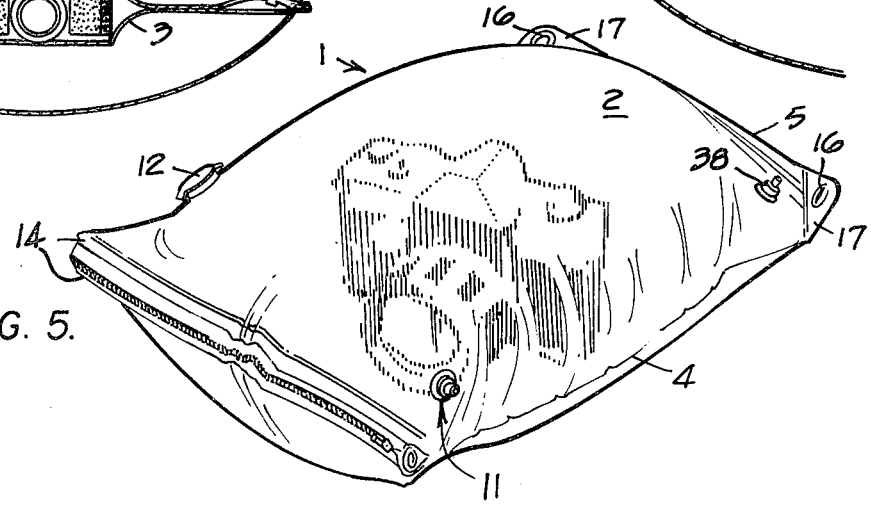
FIG. 5 is a perspective view of the inflated and zippered bouyant case with the camera locked therein.

As illustrated in FIG. 4 after the camera 9 is inserted into the compartment 6 the sleeve 7 is folded on the scored lines 13 and then rolled up as tightly as possible into the position shown in FIG. 4 and then a zipper on a pair of cover flaps 14 is pulled shut along the outside of the rolled sleeve 7. The pair of flaps 14 extend from the sealed ends 8 of the sidewalls as particularly illustrated in FIGS. 3 and 4. Thereupon the double walls are inflated through the intake valve 11 so as to create tight pressure all around the camera 9 as shown in FIG. 3 and thus tightly grip and rigidly locate the camera 9 within the case.

Suitable means such as eyelets 16 in corner flaps 17 are provided for the purpose of installing a suitable cord for handling the case.

In the embodiment of the invention shown in FIGS. 6 to 9 inclusive, the elongated case is tapered toward its closed end 21. A wall 22 of this case is double-walled having an outside wall 23 and an inside wall 24. The compartment 26 above the inner wall 24 is covered by a waterproof but flexible single wall 27 which is suitably sealed along the edges 28 and at the tail 21 to the edges of the double wall 22 so as to form the airtight compartment 26 when the open end 29 is covered and sealed.

A sleeve 31 extends in continuation of the inner wall 24 and of the flexible top 27 so as to continue in communication with the opening 29 so that objects to be stored are inserted through the sleeve 31 and arranged in the compartment 26. A top flap 32 extends in continuation from the outside of the top wall 27 and another flap 33 extends in continuation of the top wall 24 of the double wall 22 so as to encircle the rolled and folded sleeve 31 and to be connected by a zipper 34 to fasten the roll 31 in sealing position. This waterproof and airtight case can be placed in a canoe or the like and will protect the contents in the event that the boat capsizes. The outer wall 23 of the double wall 22 has an intake valve 36 and a quick-release valve 37 for the purpose heretofore described in connection with the first embodiment of the invention.

In order to facilitate the inflation of the space between respective double walls, an air-release valve 38 is communicating with the respective storage compartments 6 or 26 so that when the inflatable walls are inflated, the air is expelled from the compartment in which the articles are contained. After the inflation is completed to the desired degree, then the storage air release valve 38 is closed to prevent the entry of any substance into the respective storage compartment.

At least the inner walls of the inflatable double walls are sufficiently stretchable and resilient to allow inflating by mouth without the use of a pump or compressed air or the like, and to conform to parts of the contour of the article in the storage compartment.

The air intake valve and the storage air-release valve are of the usual push-and-pull type as shown in FIG. 10 wherein by pulling out the valve stem 39 the valve is opened and by pushing in the stem 39 the valve is closed.

Figure 11:
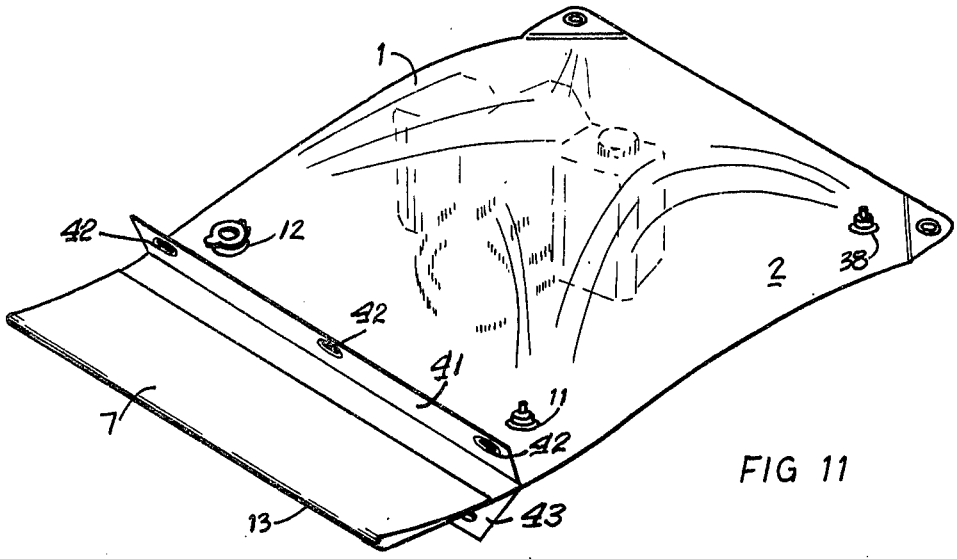
FIG. 11 is a perspective view of the modified form of the inflated case with a modified sealing end with the sealing sleeve extended and folded upon itself.
Figure 12:
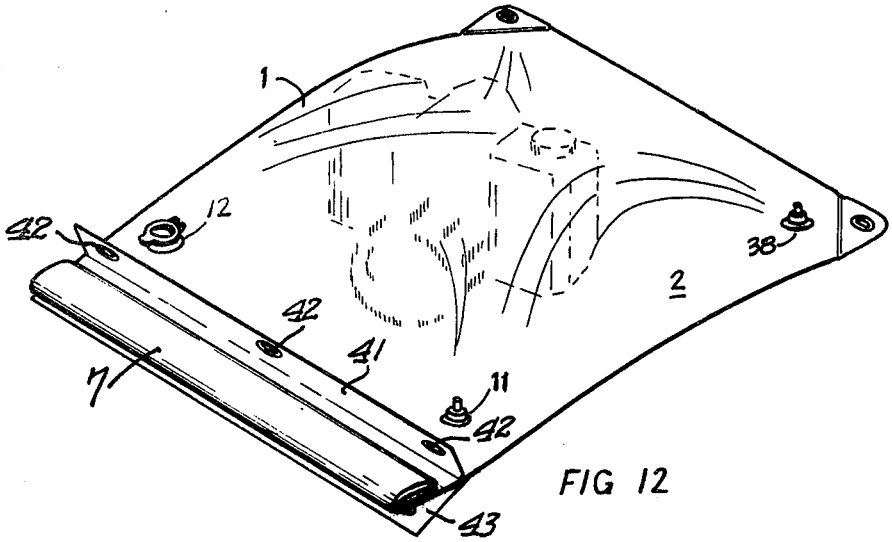
FIG. 12 is a perspective view of the modified form showing the sealing sleeve folded and rolled.
Figure 13:
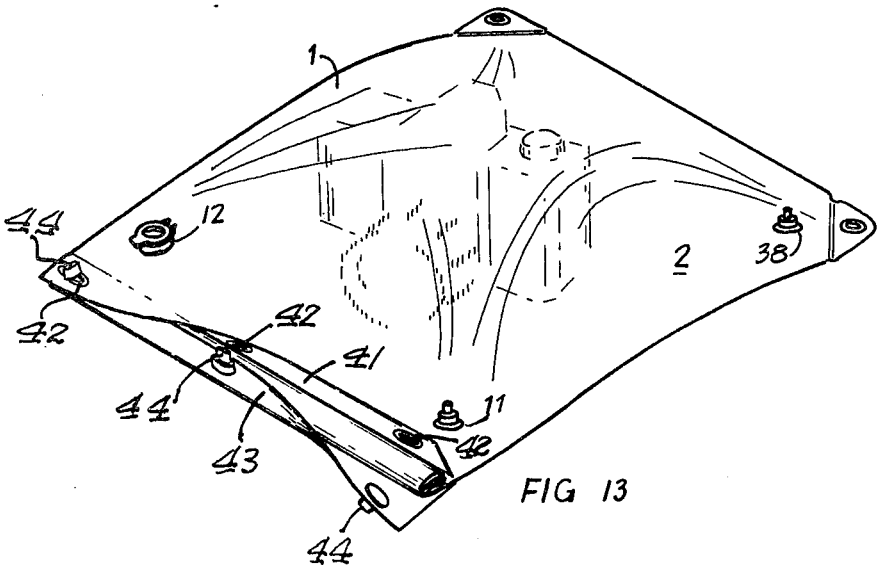
FIG. 13 shows the tight securing of the folded sleeve in position and the twist clasps.

The modified form shown in FIGS. 11, 12 and 13 is substantially the same structure as the first form heretofore described. In this form the sealing sleeve 7 is first folded upon itself as shown in FIG. 11. Then it is folded again and rolled into a roll as shown in FIG. 12. A flap 41 has a plurality of eyelets 42 thereon. The lower flap 43 has turnable clasps 44 complemental to the eyelets 42. The clasps 44 extend from the outer surface of the lower flap 43 so that when the flap 43 is folded over the roll 7 then the clasps 44 are in registry with the eyelets 42 and can be inserted therethrough and then twisted to secure the roll 7 in sealing position.

I claim:

1. In an inflatable gripping case, flexible sides enclosing a compartment, at least one flexible side having double walls to form an inflatable side, the wall adjacent said compartment being pliable so as to conform to the contour of an article in said compartment, closeable intake means for inflating said double-walled side, a portion of said compartment being open to permit the insertion of articles to be stored therein, a sleeve on said open portion of said compartment for the insertion of articles to be stored in the compartment, said sleeve being flexible and foldable;

means for securing and covering the sleeve in folded position so as to prevent water entering into said compartment, the entire periphery of said sides and said sleeve, being imperviously integrated.

2. The inflatable gripping case specified in claim 1, and normally closed means for rapid deflation of said double-wall side.

3. The inflatable gripping case specified in claim 1, wherein each of opposite sides of said case being double walled and inflatable, and at least the inner wall of said double-wall sides being stretchable to firmly embrace the article stored in said compartment upon inflation of said double walls.

4. The inflatable gripping case specified in claim 1, and said case being elongated, one side of said case being flexible and the other side of said case being inflatable and stretchable so as to embrace and press articles stored therein against the single lined flexible side.

5. The invention specified in claim 4, and a sleeve extended from the opposite sides of the compartment formed between said single flexible side and double-wall side for the introduction of articles into said compartment formed between said flexible side and said double-wall side.

said sleeve being foldable, and cover flaps extended from said flexible side and from the inner wall of said double-wall side for embracing and enclosing the folded sleeve, and means to secure said flaps together.

6. The invention specified in claim 1 and said means for securing the sleeve in folded position including a first covered flap extending from said flexible side, a second covered flap extending from one of said double walls, and separable securing elements to hold said flaps closed over the folded sleeve.

7. The invention specified in claim 6 and said securing elements being reinforced holes in one of said flaps and complemental turnable clasps on the other flap engageable with said holes.

* * * * *